US005673724A

United States Patent [19]

Abel

[11] Patent Number: 5,673,724

[45] Date of Patent: Oct. 7, 1997

[54] FAUCET

[76] Inventor: Jack Abel, 491 Wortman Ave., Spring Creek, N.Y. 11208

[21] Appl. No.: 645,097

[22] Filed: May 13, 1996

[51] Int. Cl.[6] ..... B65H 75/34

[52] U.S. Cl. ..... 137/359; 137/801; 137/810; 137/812; 4/676; 4/678; 251/366

[58] Field of Search ..... 137/606, 810, 137/811, 812, 359; 4/676, 678; 251/366

[56] References Cited

U.S. PATENT DOCUMENTS

D. 45,861 6/1914 Divekey ..... 137/359

4,126,156 11/1978 Barnes ..... 137/812

4,290,445 9/1981 Turner ..... 137/359

4,763,693 8/1988 Valley ..... 137/801

*Primary Examiner*—A. Michael Chambers

*Attorney, Agent, or Firm*—Myron Amer, P.C.

[57] ABSTRACT

A hot and cold water faucet having a concave base and hot and cold water outlets in the base which, following the concave curvature, are positioned forwardly of a rearwardly located inlet into the faucet, and thus the water connections from opposite directions to the faucet inlet converge at an angle rather than head-to-head and this contributes to better mixing into a luke warm temperature of the water flowing into the faucet.

1 Claim, 2 Drawing Sheets

FAUCET

The present invention relates generally to hot and cold water faucets in the use of which valve-controlled amounts of hot and cold water are typically intermixed so that neither too hot nor too cold, but warm, water exits from the faucet for use, and more particularly, relates to improvements in achieving a warm temperature condition in the exiting water mixture.

EXAMPLE OF THE PRIOR ART

All bases of hot and cold water faucets known to be in use are rectangular in shape, as illustrated in the prior art FIGS. 1 and 2, and, the practice has been to situate the hot and cold water outlets and the faucet inlet housed within said rectangular base at locations dictated by this shape, which is a linear relationship.

This practice need not have been followed with "Bath Tub or Similar Fitting" of U.S. Design Pat. No. 45,861 issued to J. J. Divekey on Jun. 2, 1914 because the base thereof was not of a typical rectangular shape, but a FIG. 3 perspective indicates the probable use of a linear relationship between water outlets and faucet inlet housed in the base even though, as will subsequently be explained in greater detail, a linear alignment of outlets and inlet hinders achieving proper mixing of the hot and cold water.

Broadly, it is an object of the present invention to provide an improved hot and cold water dispensing faucet overcoming the foregoing and other shortcomings of the prior art.

More particularly, it is an object to modify the directional flow paths of the hot and cold water input into the faucet which contributes to achieving a desired warm temperature in the exiting water mixtures with nominal valve manipulation, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
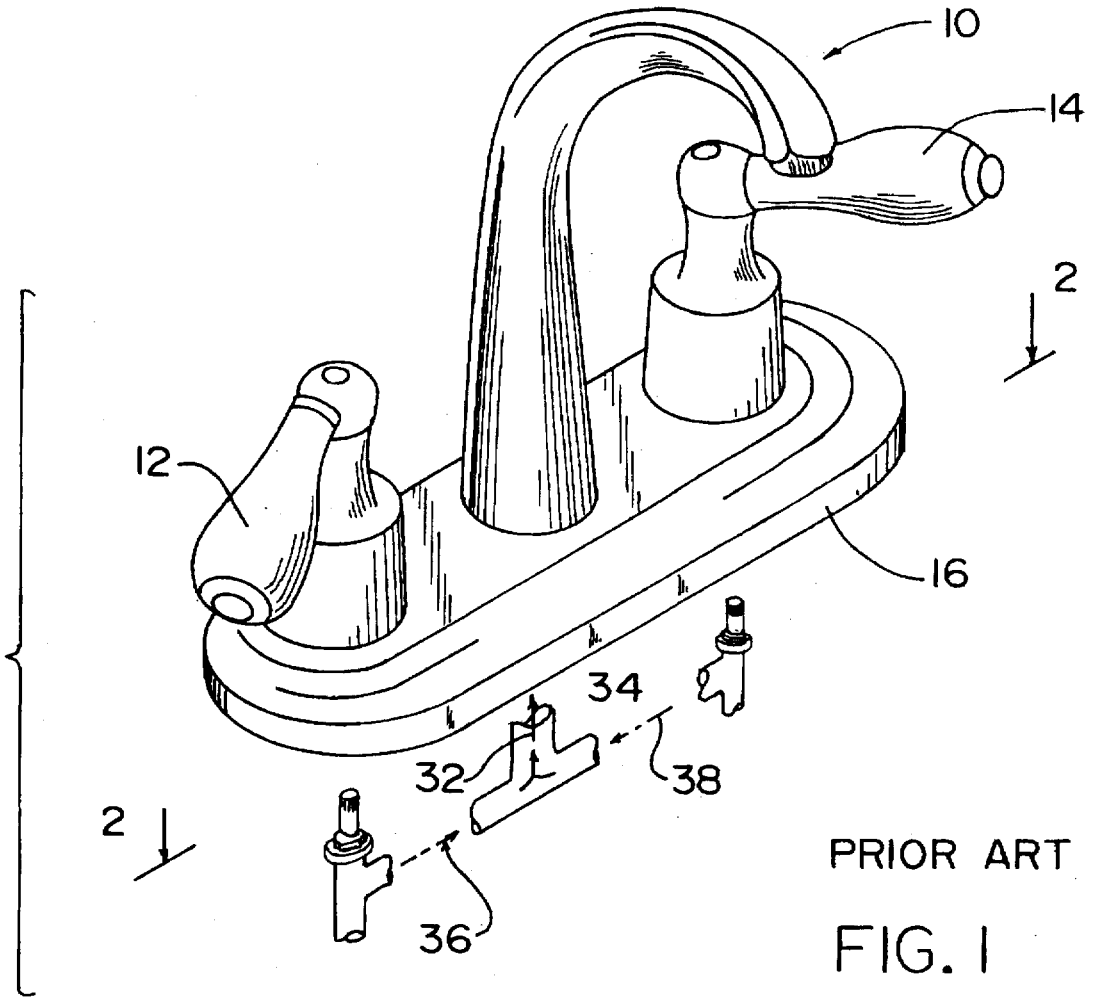
PRIOR ART FIG. 1
FIG. 1 is a perspective view of a typical known hot and cold water faucet and a simplified illustration of the water connections thereto.
Figure 2:
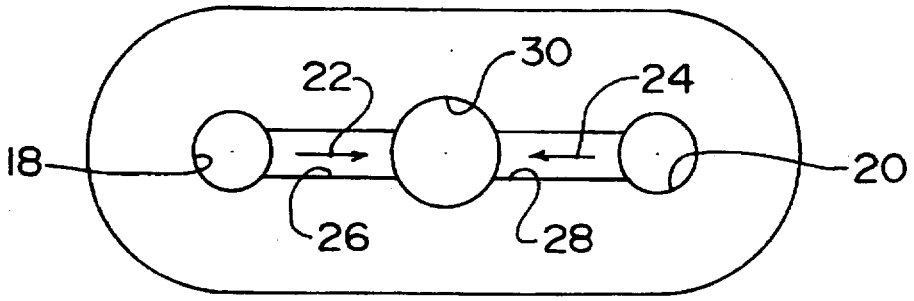
PRIOR ART FIG. 2
FIG. 2 is a plan view projected from FIG. 1 as seen along line 2—2 of FIG. 1.
Figure 3:
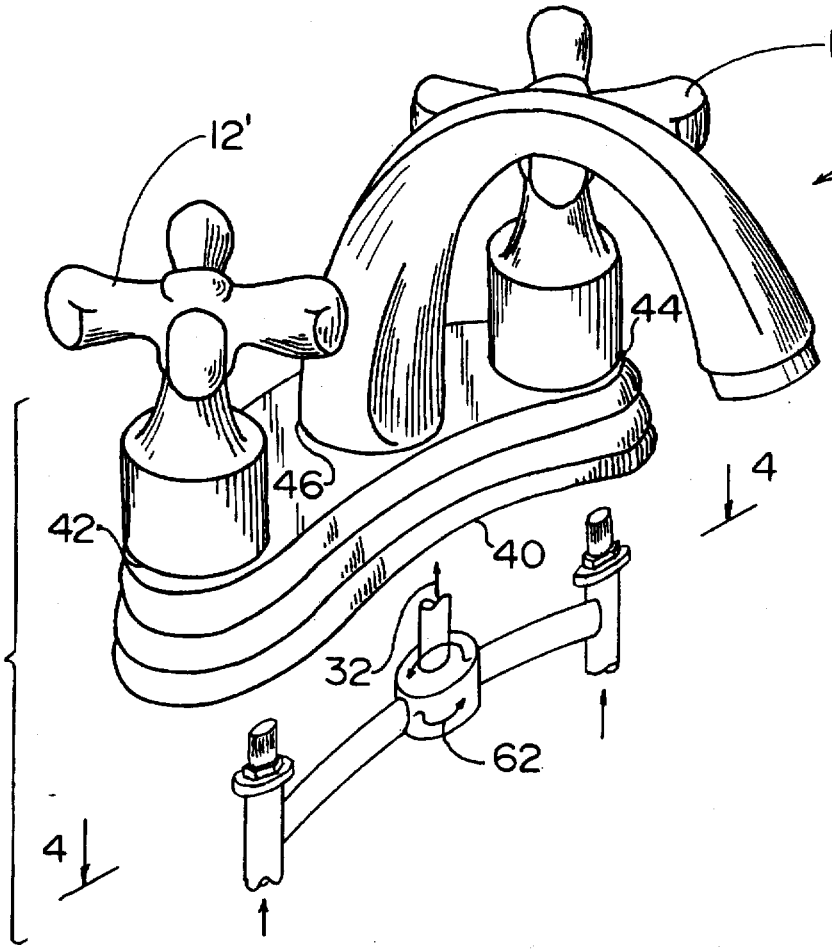
FIGS. 3 and 4 are views similar respectively to FIGS. 1 and 2 but of the within inventive hot and cold water faucet.
Figure 4:
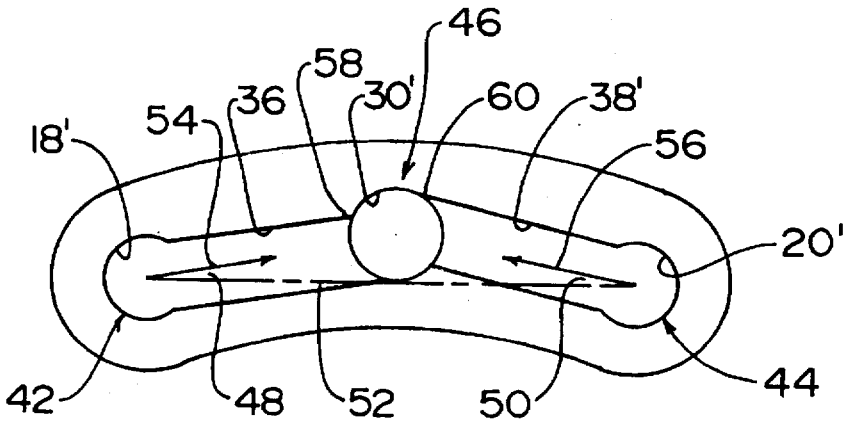

Shown in FIGS. 1 and 2, for comparison and better understanding of the within inventive faucet shown in FIGS. 3 and 4, is a faucet 10 situated between a left side hot water valve-controlling knob 12 and a right side cold water valve-controlling knob 14 wherein said faucet 10 and knobs 12, 14 are appropriately mounted, in a known manner, in a rectangular base 16 which base, as best shown in the plan view perspective of FIG. 2, houses a hot water outlet 18 at one end and, at an opposite end, a cold water outlet 20, such that valve-controlled amounts of hot water 22 and cold water 24 using the knobs 12, 14 flow from opposite directions through passage means 26 and 28 into an inlet 30 of the faucet 10 from which an intermixture of hot and cold water flows in ascending movement 32 under back pressure through passage means 34 and through the faucet 10 into a sink (not shown) or the like.

Underlying the present invention is the recognition that the intermixing of the hot and cold water at the faucet inlet 30 is hindered by the directly opposing contact of the flow paths 36 and 38 such that the exiting flow from the faucet might be too hot if the hot water pressure exceeds that of the cold water or, conversely, might be too cold if the cold water pressure is the greater. To achieve exiting flow from the faucet that is neither too hot nor too cold often requires rotative manipulation of the knobs 12 and 14 guided by feel of the temperature of the exiting flow.

The within inventive faucet as shown in FIGS. 3 and 4 embodies improvements, as will now be described, which contributes to facilitated intermixing of the hot and cold water and the obviating, for all intents and purposes, and pressure differences in the cold water and hot water inputs into the faucet. In FIGS. 3 and 4, the structural features already described in relation to FIGS. 1 and 2 are designated by the same but primed reference numerals, to enhance immediate recognition of the improvements designated by an unprimed reference numeral.

More particularly, according to the present invention faucet 10' and the hot water and cold water valve-controlling knobs 12' and 14' are appropriately mounted in a concave curved base 40 which, as may be best understood from the plan view perspective of FIG. 4, situates the hot water outlet 18' and cold water outlet 20' at opposite ends and in forward locations, denoted at 42 and 44 in the base 40 and situates the faucet inlet 30' in the middle and in a rearward located, denoted at 46 of the base 40. As a consequence, the flow passages 36' and 38 following the concave curvature of the base 40, are connected from the outlets 18' and 20' to the faucet inlet 30' at subtending acute angles 48 and 50 to a reference line 52 connected directly between the centers of the outlets 18', 20'. The flow paths 54 and 56 of the hot and cold water into the inlet 30' are thus not in direct opposition to each other, but are at the acute angles 48 and 50, thereby obviating pressure difference in the hot and cold water that have heretofore interfered with achieving desired temperatures in the water mixture exiting from the faucet 10'.

Optionally, the ends 58 and 60 of the flow passages 36' and 38' at the inlet 30' can be connected in tangential relation thereto which, in practice, causes a rotative movement 62 in the incoming water and an optimum intermixing of the hot and cold water at inlet 30' and subsequently during the ascending movement 32' thereof incident to exiting flow from the faucet 10'.

While the apparatus herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. Improvements for a hot and cold water faucet of a type in which hot water and cold water flow from opposite directions into intersecting relation incident to flowing through said faucet preparatory to use, said improvements comprising an inlet into said faucet and outlets for said hot water and said cold water housed in a concave curved base in plan view perspective wherein said outlets for said hot water and said cold water are situated at opposite ends and in forward locations of said concave curved base and said faucet inlet is situated in the middle and in a rearward location of said concave curved base, flow passage means connected from each said outlet of said hot and cold water to said faucet inlet at subtending acute angles to a reference line connected directly between said outlets, and opposite direction flow of said hot and cold water each in a flow path at said subtended acute angle adapted to impinge with each other beneath said faucet inlet for entering in a mixed condition into said faucet inlet, whereby said impingement of said hot and cold flowing water at said acute angular relation to each other contributes to improved intermixing thereof.

* * * * *